United States Patent [19]

Ingraham

[11] 4,162,281

[45] Jul. 24, 1979

[54] CARBURETOR FUEL ATOMIZATION APPARATUS

[76] Inventor: Robert E. Ingraham, 13 Hampstead Rd. Box 696, South Danville, N.H. 03881

[21] Appl. No.: 879,474

[22] Filed: Feb. 21, 1978

Related U.S. Application Data

[63] Continuation-in-part of Ser. No. 783,001, Mar. 30, 1977, abandoned.

[51] Int. Cl.[2] ..... F02M 69/08

[52] U.S. Cl. ..... 261/30; 261/41 R; 261/64 R; 261/DIG. 39; 261/DIG. 51; 261/DIG. 74; 261/127 B; 123/33 E; 123/131; 361/178; 137/625.3; 137/625.38

[58] Field of Search ..... 261/30, DIG. 51, DIG. 39, 261/64 R, 121 B, DIG. 74, 41 D; 123/33 E, 131

[56] References Cited

U.S. PATENT DOCUMENTS

| | | | |
|---|---|---|---|
| 715,548 | 12/1902 | Cary | 261/DIG. 51 |
| 907,123 | 12/1908 | Broderick | 123/131 |
| 1,366,445 | 1/1921 | Charter | 123/131 |
| 1,868,767 | 7/1932 | Ross | 123/131 |
| 1,926,449 | 9/1933 | Lindsey | 261/DIG. 51 |
| 1,998,784 | 4/1935 | Mock | 261/DIG. 51 |
| 2,012,564 | 8/1935 | Holmes | 261/DIG. 51 |
| 2,219,522 | 10/1940 | Hinsch | 123/133 |
| 2,310,895 | 2/1943 | Brown | 261/30 |
| 2,482,864 | 9/1949 | Nemnich | 123/131 |
| 3,304,011 | 2/1967 | Paasche | 261/30 |
| 3,376,027 | 4/1968 | Kopa | 261/DIG. 39 |
| 3,531,094 | 9/1970 | Andrew | 261/30 |
| 3,610,213 | 10/1971 | Gianini | 123/33 E |
| 3,664,818 | 5/1972 | Kramer | 261/DIG. 39 |
| 3,674,245 | 7/1972 | Massarotti | 261/DIG. 51 |

FOREIGN PATENT DOCUMENTS

| | | | |
|---|---|---|---|
| 753913 | 4/1933 | France | 261/DIG. 51 |

*Primary Examiner*—Tim R. Miles
*Attorney, Agent, or Firm*—John C. MacNab

[57] ABSTRACT

Apparatus for feeding compressed air to an automobile carburetor including a compressor, a compressed air holding tank, an electric air regulator control switch, a manually operated air regulator valve, a solenoid controlled flow valve, tee connections to idler jets, a cylinder and an air line connecting all of the aforesaid devices in sequence. The cylinder has a piston therein connected to a lever plate mounted on the throttle valve shaft in the cylinder of the automobile. The lever plate is connected by linkage to the accelerator pedal of the automobile.

5 Claims, 10 Drawing Figures

CARBURETOR FUEL ATOMIZATION APPARATUS

This is a Continuation in Part of application Ser. No. 783,001 filed Mar. 30, 1977, now abandoned.

This invention relates to apparatus for mixing air and liquid fuel, either oil or gasoline, and atomizing the gaseous mixture into a carburetor or fuel burner of an automobile or into a combustion chamber of a furnace.

Formerly the liquid fuel and air were mixed within the carburetor or burner and not prior to entering the carburetor or burner. This resulted in an incomplete combustion and waste of unburned liquid fuel which passed into the exhaust system and out to the atmosphere, polluting the same with an invisible or visible noxious gas often seen as a blue smoke behind an automobile or a visible smoke from a chimney. This loss of unburned fuel results in less mileage per gallon of liquid fuel in the operation of an automobile on the highway and/or the inefficient operation of a burner in a furnace.

One of the objects of this invention is to provide a new and novel means for charging a carburetor or internal combustion cylinder of an automobile with a charge of combustible gaseous mixture.

Another object of this invention is the construction of a device for making the gaseous combustion charge prior to its entry into the cylinder of an automobile or the fire box of a furnace.

A further object of this invention is the atomization of the gaseous mixture of air and fuel into the combustion chamber of an automobile engine or combustion chamber of a furnace.

A further object of this invention is to provide an apparatus for forming a controlled mixture of air and fuel and the atomization of the mixture into a carburetor or combustion cylinder of an automobile.

Other objects and advantages of this invention are the inexpensive manufacture of the device, its efficiency and simplicity of control of operation, all of which will become apparent to those skilled in the art, described below and illustrated in the accompanying drawings in which.

The following description of applicant's device will be confined to application of the invention to automobile engines although it is understood that such description is also applicable to combustion chambers of industrial furnaces and is not limited to automobile engines.

Figure 1:
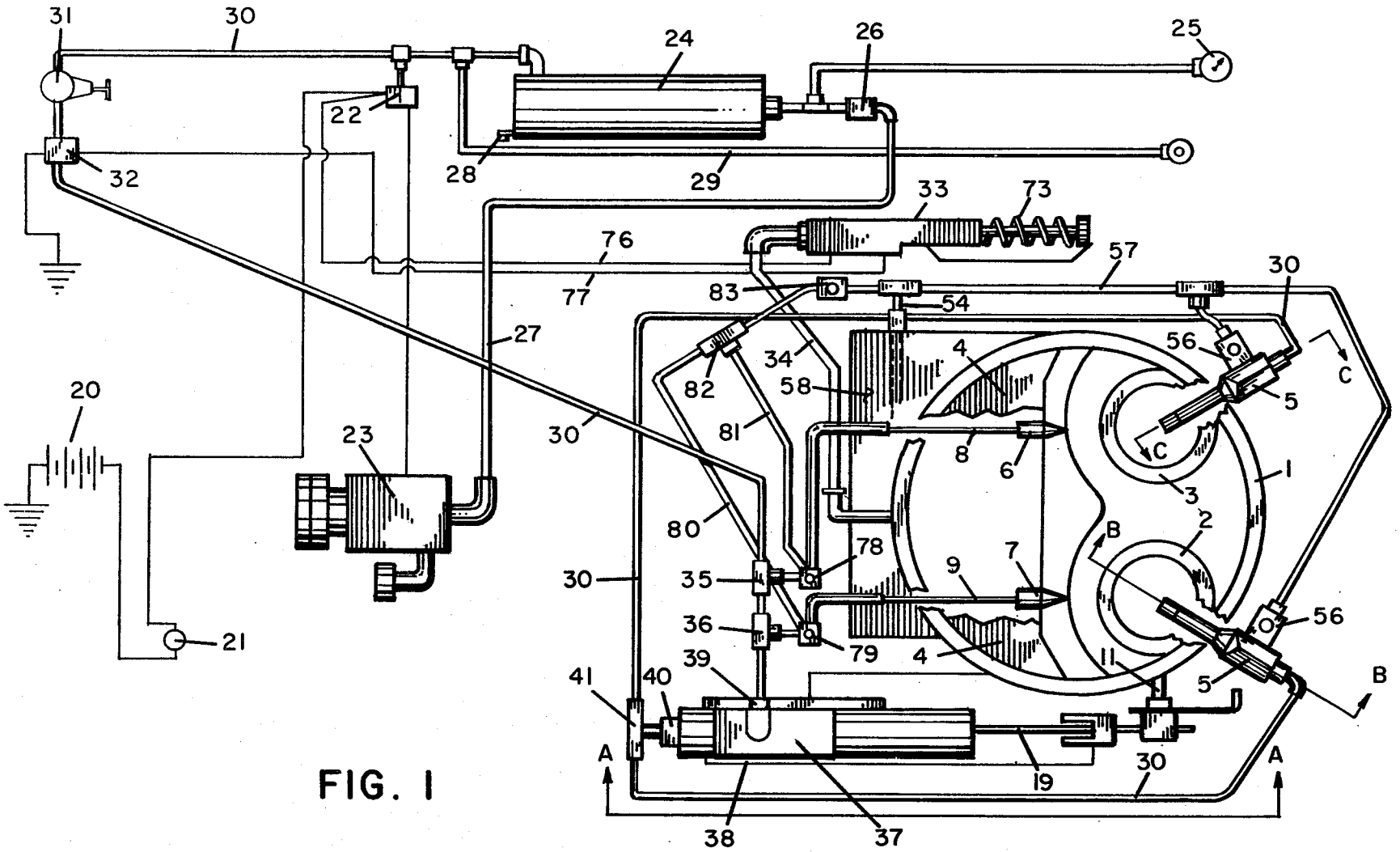
FIG. 1 is a top view of the complete assembly of applicant's apparatus.
Figure 2:
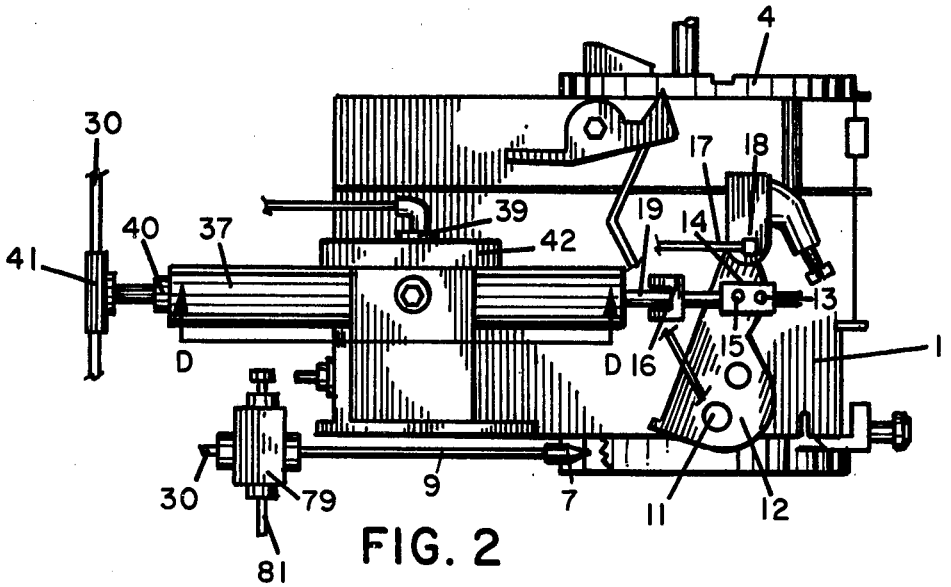
FIG. 2 shows a side view of the idler mechanism taken on plane A—A of FIG. 1.
Figure 3:
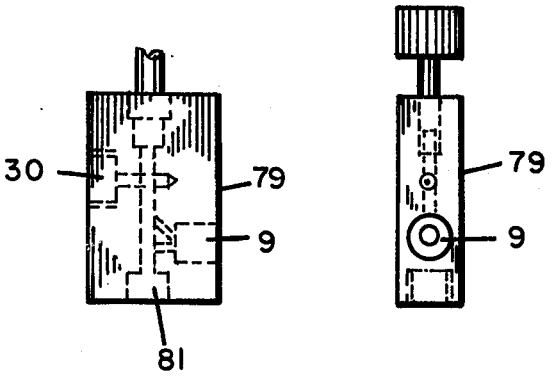
FIG. 3 is a view taken on plane B-B of FIG. 1 showing a cross section of one of the barrels of the carburetor.
Figure 3:
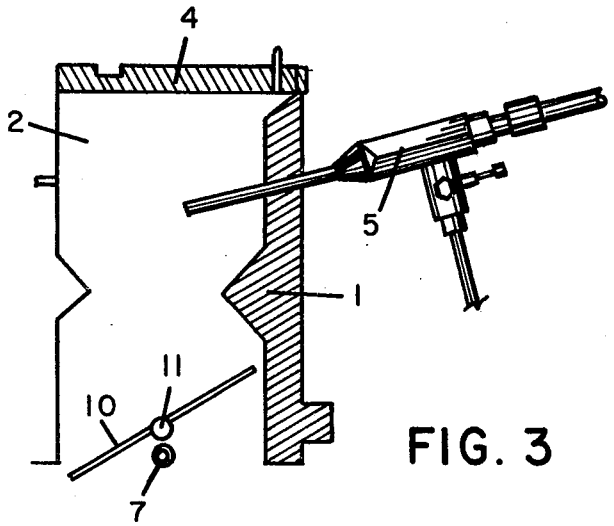
Figure 4:
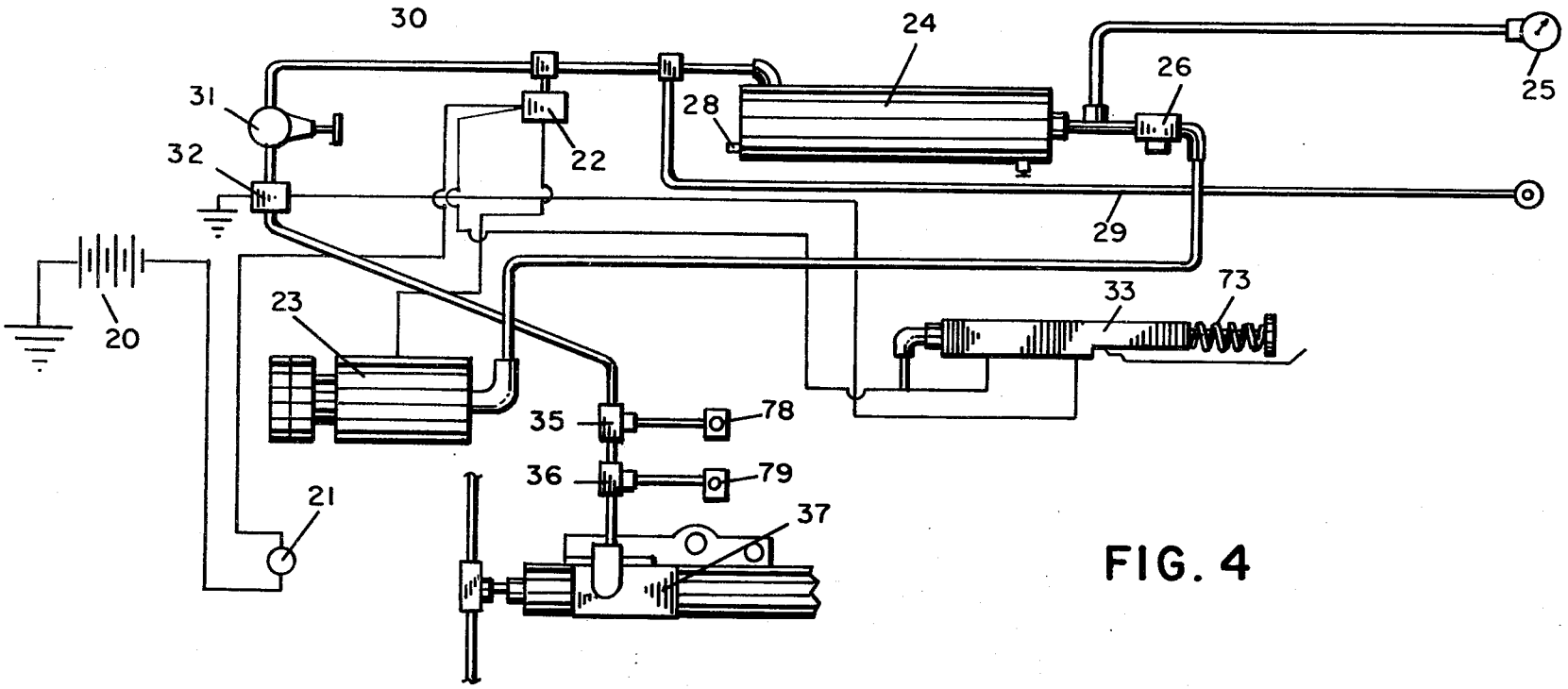
FIG. 4 shows a top view of the air supply means assembly of FIG. 1.

In the complete assembly, illustrated in FIG. 1, numeral 1 indicates a carburetor having two (2) barrels 2 and 3 therein. A cover 4, forming a mounting for an air filter not shown, is shown in FIGS. 2 and 3 and fragments of which are shown in FIG. 1 covers the top of the carburetor. Atomizer nozzles 5 designed to produce conical sprays of air and liquid fuel enter the wall of the carburetor 1 and each of the barrels 2 and 3, FIG. 1. The discharge ends of these nozzles are located in the area of minimum suction caused by the venture action in the carburetor. For example see FIG. 3 showing in cross section one of the barrels 2.

idler jets 6 and 7 fed by tubes 8 and 9 also enter carburetor 1 as shown in FIG. 1. FIGS. 2 and 3 show entry of one of the idle jets 7 into the carburetor beneath throttle plate 10, FIG. 3, mounted on shaft 11. Shaft 11 passes through the wall of the carburetor 1 and carries a lever plate 12 rotably mounted thereon at 13. To the outer end of shaft 11 a sleeve 14 is pivotally mounted on the lever plate 12. This sleeve 14 is pinned at 15 to a yoke 16. The lever plate 12 is linked to the accelerator pedal by a link 17, FIG. 2. Yoke 16 is attached to a piston rod 19 best seen in FIG. 2. The piston 45 attached to the piston rod FIG. 6 will be described below.

In the above paragraph I have described in detail the carburetor and its various connections. This invention is not limited to a particular carburetor but applies to liquid burning chambers generally.

FIG. 1 shows a storage battery 20 and electric connections to an ignition switch 21. This switch 21 is connected to an electric air regulator control switch 22 later described in detail. A second electric connection to said air regulator control switch 22 goes to an air compressor 23. The compressor supplies air under pressure of 40 to 60 pounds per square inch to a holding tank 24 in which air is retained under pressure of from 40 to 60 pounds. An air pressure guage 25 is connected to said tank and a one way check valve 26 is in the air line 27 between the compressor and the holding tank 24. The holding tank 24 has a drain out plug 28 to relieve any condensation which may collect in the tank 24. Air pipe 30 attached to tank 24 has a pipe 29 connected therewith to provide air for other uses. Beyond this auxiliary air line connection to pipe 30 is a connection to the electric air regulator control switch 22. Air line 30 continues past the air regulator control switch 22 to a manually operated air regulator valve 31 and to a solenoid controlled flow valve 32. The solenoid switch flow valve 32 is grounded and electrically connected to a vacuum control switch 33 which is connected by a tube 34 with the carburetor 1. From the solenoid switch flow valve 32 air line 30 continues through two tee connections 35 and 36 to the cylinder 37 attached to the base 38, FIG. 1.

Figure 6:
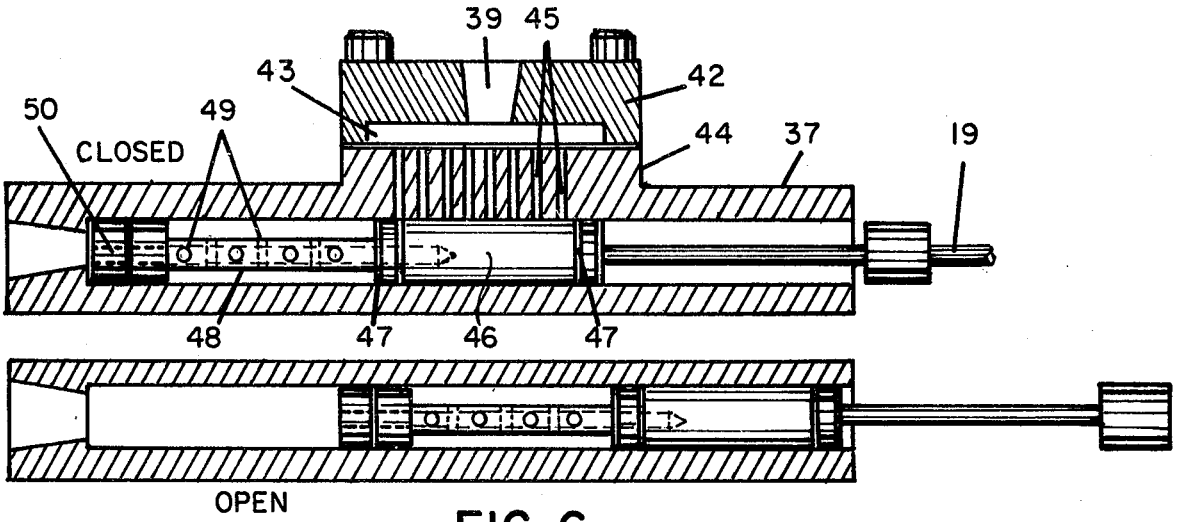
FIG. 6 shows the air piston valve in cross section taken on a vertical longitudinal plane D—D through the air piston valve cylinder 37, FIG. 2.

Cylinder 37 has an inlet for air line 30 at 39 shown in FIGS. 1, 2 and 6 and an outlet 40, FIGS. 1 and 2. To another portion of air line 30 is connected to a tee 41 from which air line 30 extends in one direction to one of the atomizer nozzles 5 and a second air line 30 extends to the other atomizer nozzle 5. The inlet 39 includes a block 42, FIG. 6, having an air chamber 43 and a second block 44 having several bores 45 therethrough to pass the air from the inlet to inside of the cylinder 37. Within cylinder 37 is a piston 46 attached to the end of piston rod 19. This piston 46 carries "O" rings 47 to make a sliding fit with the inner wall of cylinder 37. A portion of the piston 46 is reduced in diameter as at 48 to provide a hollow tube having openings 49 therethrough.

The outer end of the piston 46 has a central bore 50. The action of the piston in the cylinder allows varying amounts of air to pass from the inlet to the outlet of the cylinder dependent upon the pressure of one's foot on the accelerator pedal 17. Cylinder 37 supplies air continuously during engine operation.

Gasoline is fed from the fuel bowl 58, FIG. 1, of the carburetor by suction of the air passing through nozzles 5.

Figure 5:
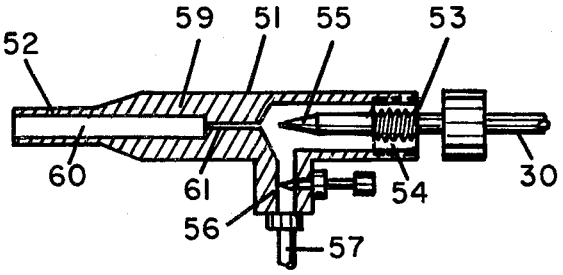
FIG. 5 shows a sectional view of one of the atomizer nozzles 5 taken on plane C—C of FIG. 1.

The cross section of an atomizing nozzle 5 is shown in FIG. 5. Numeral 51 indicates the nozzle having at one end an outlet portion 52 and an adjustable air inlet 53 at the other end. A plug 54 having a conical end 55 and an air opening therethrough is attached to the air pipe 30, FIGS. 1 and 5. A metering valve 56, FIG. 5, is attached to the side of the nozzle and a gasoline line 57 is connected to the metering valve. A needle valve extends into the side of the metering valve 56 and this metering valve 56 receives gasoline from tube 57 which obtains its fuel from the fuel bowl 58 of the carburetor FIG. 1. Fine adjustment between the air and gasoline is made. The outlet end of the nozzle 5 has a block 59 therein with a large bore 60 at its outer end and a small bore 61 with conical shape at its inner end. This metering valve 56 determines the amount of gasoline sucked in by the air coming through the nozzle.

Figure 7:
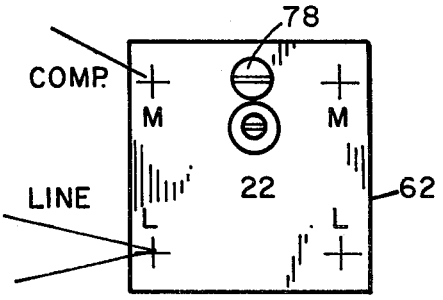
FIG. 7 is a top view of the air regulator control switch 22 of FIG. 1.
Figure 8:
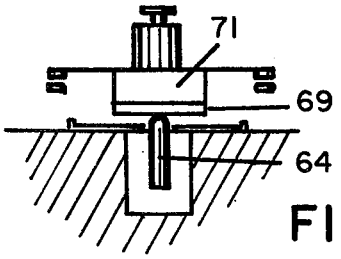
FIGS. 8 and 9 show inside views of the air regulator control switch mechanism.
Figure 9:
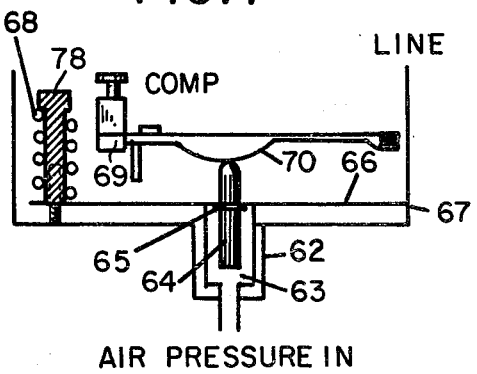

The air regulator control switch 22 FIG. 1 is shown in detail in FIGS. 7, 8 and 9. It includes a metal box like structure 62 having an air inlet at 63, FIG. 9, connected with air line 30. The air pressure bears against a piston 64 a portion of which 65 bears against plate 66 rigidly connected to the box 62 at one end 67 and provided with an adjustable spring 68 at the other end. Adjustment of spring 68 can be accomplished by rotating spring adjustment member 78 on a threaded shaft which threads in at the base of spring adjustment member 78 or by equivalent well-known means for spring tension adjustment. Spring adjustment member 78 can be rotated by using a screwdriver inserted in the slot in its top as seen in FIG. 7. The piston 64 extends beyond plate 66 to a fixed block 69, FIG. 8, carrying a spring element 70, FIG. 9, operating a switch block 71. Spring 68 is adjusted to pressure of 40 to 60 pounds of air as desired. When the pressure rises spring 68 is compressed and allows piston 64 to trip spring element 70 which causes switch block 71, FIG. 8, to break the electric connections to the compressor 23 and the ignition switch 21.

Figure 10:
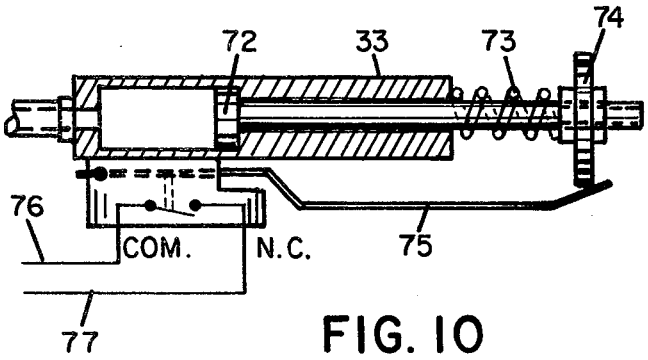
FIG. 10 is a cross sectional view of the vacuum control switch 33 of FIG. 1.

The vacuum control switch 33 shown in FIGS. 1 and 10 is connected by vacuum tube 34 to the carburetor 1. The vacuum control switch carries a piston 72, FIG. 10, spring pressed by spring 73 toward outward position. The outer end of the piston 72 has an enlarged portion 74 which contacts a leaf spring 75 which through electric wire 76 breaks a contact in the air regulator control switch 22. A second electric wire 77 extends from the vacuum control switch 33 to the solenoid controlled flow valve 32. This vacuum control switch 33 will operate only when the engine is operating and therefore acts as a safety switch. In FIG. 10 "Com." stands for common and "N.C." stands for non-common.

The two tees 35 and 36 located in the air line 30 above the connection 39 to the cylinder 37 shown in FIG. 1 are connected by short air pipes to idler regulating and mixing valves 78 and 79. Fuel lines 80 and 81 connect to the idler and mixing valves 78 and 79 and joint to a tee 83. The fuel line 57 mentioned above extends to the left from a tee connection going into the fuel bowl 58 to a metering valve 83 for the idler jets. The idler jets 6 and 7 FIG. 1, have their feed pipes 8 and 9 connected to the idler valves 78 and 79 and operate when the engine is turned on.

The cylinders 2 and 3 are provided with the usual spark plugs not shown.

The operation of the device is as follows: Assuming that the automobile has been serviced with oil and gasoline, the ignition switch 21, FIG. 1, is turned on and electricity flows from the battery 20 to the electric air regulator control switch 22. The ignition switch starts the engine in the usual way and gasoline is sucked in from the fuel bowl 58 of the carburetor filling pipes 57 and metering valves 56 connected to the nozzles 5. My device uses compressed air along with the usual air drawn in by the operation of the pistons through an air filter.

The air supply comes from a motor compressor 23 controlled by the electric air regulator control switch 22. The air from the compressor passes to a pipe 27 and a one way valve 26 to the holding tank 24 which contains air at between 40 and 60 pounds pressure. Air passes out of the holding tank through pipe 30 which has a connection with the air regulator control switch 22 and a manually operated air regulator valve 31, and a solenoid controlled flow valve 32. From this flow valve 32 air pipe 30 continues past two tee connections which permit air to feed two idler jets 6 and 7 and to a cylinder 37. The cylinder 37 contains an air valve shown in FIG. 6 which controls the amount of air permitted to flow to the atomizier nozzles 5. The piston 46 in cylinder 37 is connected to the accelerator by linkage. To speed up the automobile the accelerator pedal 17 is pressed and the piston 46 permits more air to go to the nozzles.

The vacuum control switch 33 is connected to the carburetor and electrically connected to the air regulator control switch 22 and to the solenoid controlled flow valve 32. When the vacuum in the cylinder of the engine ceases the vacuum control switch 33 operates to stop the engine. When the engine is turned on the vacuum control switch is again active. The air regulator control switch 22 completes a circuit to the solenoid switch flow valve 32 only when the engine is running. The vacuum control switch 33 can receive current from the air regulator control switch 22 which current ultimately comes from ignition switch 21 when their respective lines join at the line pole of 22 as seen in FIGS. 1 and 7.

I claim:

1. In a carburetor fuel atomization apparatus including a compressed air tank, an electric air regulator control switch, a manually operated air regulator valve, a solenoid controlled flow valve, two tee connections, a cylinder, an air pipe means connecting all of the units above recited to the air pipe in sequence, idler jets means connecting idler jets to the two tees, air control piston means in said cylinder, an inlet connection on said cylinder, a piston rod, a lever plate linkage means connecting said piston rod to a lever plate, a throttle plate, pivot means connecting the throttle plate to the lever plate, an eccelerator pedal, a link connecting the accelerator pedal to the lever plate, an outlet connection on the cylinder, a outlet air pipe, means connecting the outlet connection of the cylinder to the outlet air pipe, a tee on the end of the outlet pipe, means connecting the opposite end of the tee to atomizer air pipes, said atomizer air pipes extending to atomizer nozzles and means adjustably connecting said atomizer air pipes to said nozzles.

2. The structure of claim 1 wherein there is a vacuum control switch comprising a cylinder, a piston, means mounting said piston in said cylinder, one end of the cylinder being open to atmosphere, the other end of said cylinder being closed and having a vacuum pipe, means connecting the vacuum pipe to the closed end of the cylinder, a carburetor said vacuum pipe extending into the carburetor, means mounting said piston in said cylinder, an enlarged disc, means attaching said disc to the outer end of the piston, the outer end of the piston extending beyond the cylinder, a spring between the outer end of the piston and the cylinder to urge the piston outwardly and an electrical connection between said vacuum control switch and said solenoid controlled flow valve, and a second electrical connection between the vacuum control switch and the electric air regulator control switch, said vacuum control switch operating only when the automobile engine is operating.

3. The structure of claim 2 wherein said cylinder further includes an elongated cylindrical casing, means defining a cylindrical bore extending longitudinally from one end of said casing to a conically shaped outlet at the other end of the casing, the larger end of said conically shaped outlet being at the end of the casing, means providing an opening in side walls of the cylindrical casing, a block, means mounting said block in said opening, said block extending outside of said opening and having an inner cylindrically shaped portion conforming to the inner wall of the cylindrical bore, the surface opposite said inner wall being smooth, means providing a series of openings through said block from the inner wall to the surface opposite said inner wall, a second block, means fixedly attaching said second block to the smooth surface of the first block, means providing a recessed portion in the second block open to the series of openings to form a chamber, and means forming an opening from said chamber for connection to said outlet pipe.

4. The structure of claim 3 further including on said cylinder's piston an elongated head on said piston rod, said head having a solid cylindrical portion of a diameter substantially that of the inside of a cylinder in which the piston is to be used, a second portion of the piston rod, said second portion being hollow and of a much less diameter than the solid cylindrical portion, means providing transverse openings through the second portion of the piston, a third and end portion of said piston having the same diameter as said solid cylindrical portion, means providing an opening longitudinally through said third portion of the same diameter as that of the second portion and forming an extension thereof.

5. The structure of claim 4 wherein said vacuum control switch further includes means defining two connecting bores of large and small diameter in said cylinder, a closure plate, means fixedly attaching said closure plate to the end of the cylinder to close said large diameter bore, means defining an opening through said closure plate, a piston rod, means mounting said piston rod in the means providing said small diameter bore, a solid disc head, means fixedly attaching said solid disc head to one end of the piston, the size of said solid disc head conforming to the large diameter bore, a large disc, means fixedly mounting said large disc on the other end of said piston rod, said spring being a coil spring, the coil spring bearing upon the end of the cylinder at one end and upon the large disc at the other to urge the piston outwardly, an electric switch, means mounting said electric switch to the wall of the cylinder adjacent the large diameter bore of the cylinder, electric connections to the switch, a leaf spring, means mounting one end of the leaf spring in said electric switch to actuate said switch, means on the other end of the leaf spring bent to slidally contact the large disc means mounted on the piston rod, when a vacuum occurs in the large bore of the cylinder the piston rod moves toward the closure plate and disengages the large disc on the piston rod from the end of the leaf spring and the electric switch is actuated to disconnect the switch.

* * * * *